US010315302B2

(12) United States Patent
Lin

(10) Patent No.: US 10,315,302 B2
(45) Date of Patent: Jun. 11, 2019

(54) TOOL ASSEMBLY

(71) Applicant: Jun-Yi Lin, Taichung (TW)

(72) Inventor: Jun-Yi Lin, Taichung (TW)

( * ) Notice: Subject to any disclaimer, the term of this patent is extended or adjusted under 35 U.S.C. 154(b) by 192 days.

(21) Appl. No.: 15/465,619

(22) Filed: Mar. 22, 2017

(65) Prior Publication Data

US 2018/0272518 A1 Sep. 27, 2018

(51) Int. Cl.
*B25B 23/00* (2006.01)
*B25G 1/08* (2006.01)
*B25G 1/06* (2006.01)

(52) U.S. Cl.
CPC ..... *B25G 1/063* (2013.01); *B25B 23/0028* (2013.01); *B25G 1/066* (2013.01); *B25G 1/085* (2013.01)

(58) Field of Classification Search
CPC ..... B25B 23/0028
USPC ..... 81/177.2, 177.5, 177.6, 177.7
See application file for complete search history.

(56) References Cited

U.S. PATENT DOCUMENTS 4,996,896 A * 3/1991 Bachand ..... B25G 1/066 81/177.7
6,378,701 B1 * 4/2002 Kuo ..... B25B 15/008 206/378
6,386,074 B1 * 5/2002 Yang ..... B25B 13/481 81/177.7
6,629,478 B2 * 10/2003 Kozak ..... B25G 1/085 81/177.4
7,287,450 B1 * 10/2007 Liao ..... B25B 15/02 81/177.7
7,866,235 B2 * 1/2011 Hi ..... B25G 1/085 81/177.7
8,209,818 B2 * 7/2012 Lin ..... B25G 1/066 16/111.1
2014/0090522 A1 * 4/2014 Huang ..... B25B 15/02 81/177.8
2015/0101461 A1 * 4/2015 Li ..... B25G 1/043 81/438

* cited by examiner

*Primary Examiner* — Hadi Shakeri

(57) ABSTRACT

A tool assembly includes a first body, a connector and a second body. The first body has a first end and a second end. A slot is defined through the wall of the body and extends from the second end of the first body to the middle portion of the first body. The slot includes a first end having a first connection portion, and a second end having a second connection portion. The connector is mounted to the second body and has an outer threaded section. The outer threaded section is threadedly connected to either the first connection portion or the second connection portion of the first body to locate the first body at different angular position relative to the second body.

9 Claims, 16 Drawing Sheets

TOOL ASSEMBLY

BACKGROUND OF THE INVENTION

1. Fields of the Invention

The present invention relates to a tool assembly, and more particularly, to a tool assembly which includes a first body and a second body, the second body is positioned at two positions relative to the first body.

2. Descriptions of Related Art

One of the conventional tool assemblies known to application includes a function head which is connected to a handle bar at different position so as to form an L-shaped tool assembly or a T-shaped tool assembly. However, the function head has to be drilled with receiving recess to be cooperated with the corresponding connection portions on the handle, therefore, the manufacturing cost for the function head is high and does not accepted by the users.

Besides, there are resilient rings located at the receiving recess so as to ensure that the connection between the function head and the handle is secure. Nevertheless, the resilient rings tend to be worn out or even broken to affect the connection between the function head and the handle.

The present invention intends to provide a tool assembly to eliminate the shortcomings mentioned above.

SUMMARY OF THE INVENTION

The present invention relates to a tool assembly and comprises a first body, a connector and a second body. The first body has a first end and a second end. A slot is defined through the wall of the body and extends from the second end of the first body to the middle portion of the first body. The slot includes a first end having a first connection portion, and a second end having a second connection portion. The connector is mounted to the second body and has an outer threaded section. The outer threaded section is threadedly connected to either the first connection portion or the second connection portion of the first body to locate the first body at different angular position relative to the second body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
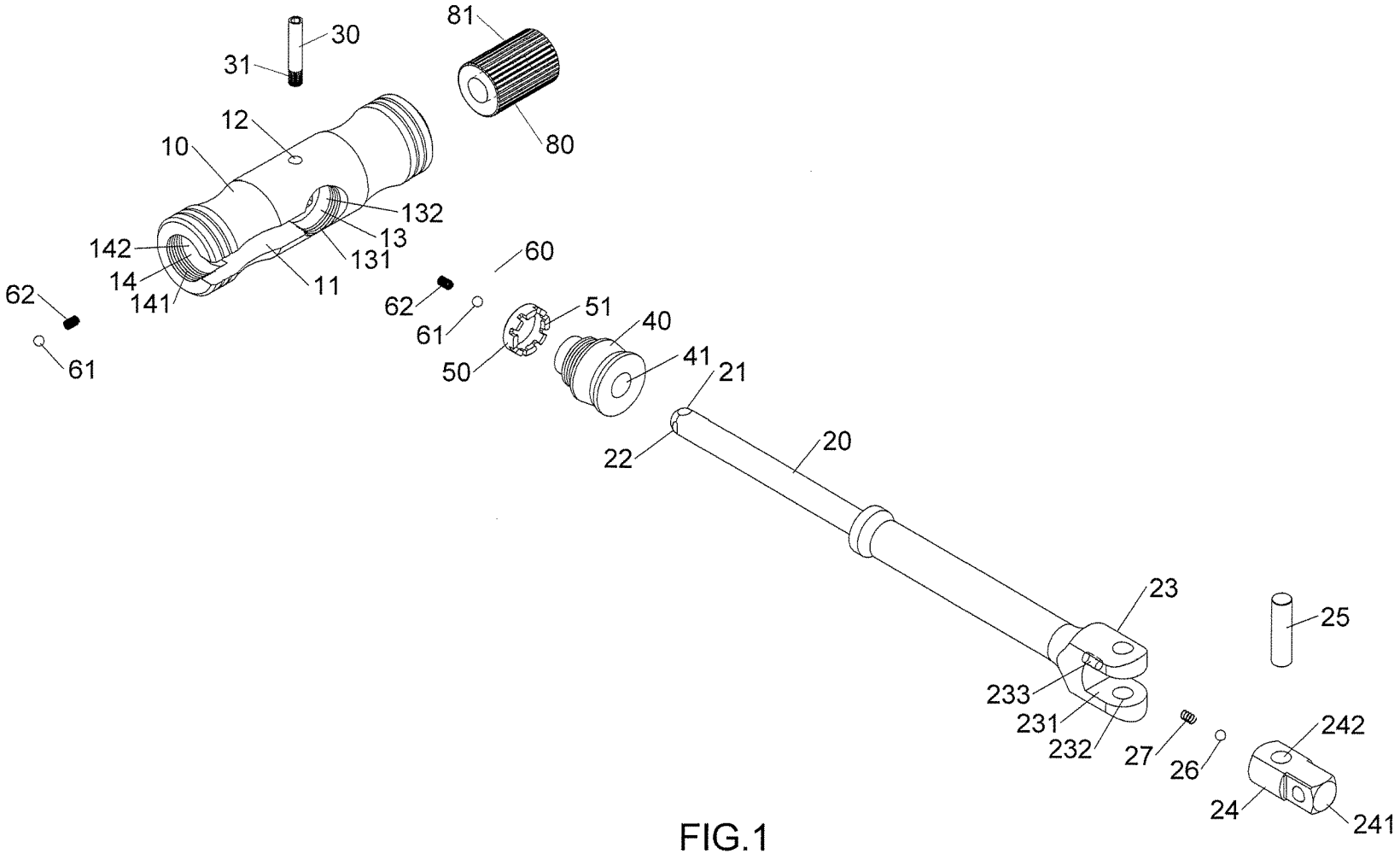
FIG. 1 is an exploded view of the tool assembly of the present invention.
Figure 2:
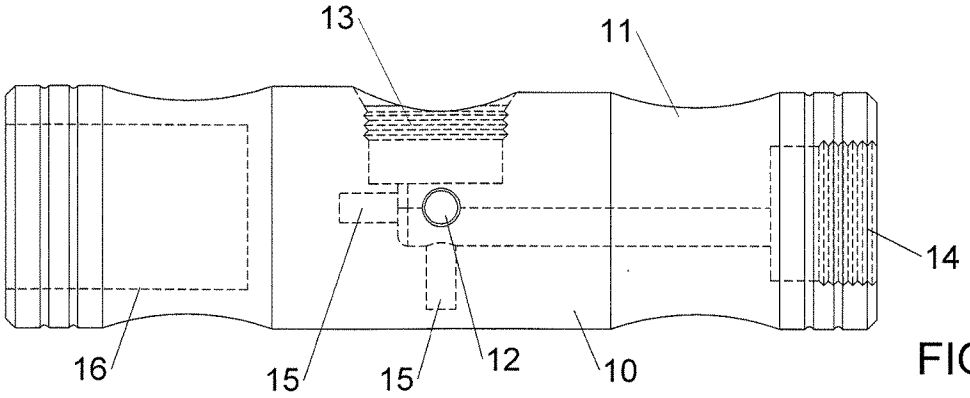
FIG. 2 is a side view of the first body of the tool assembly of the present invention.
Figure 3:
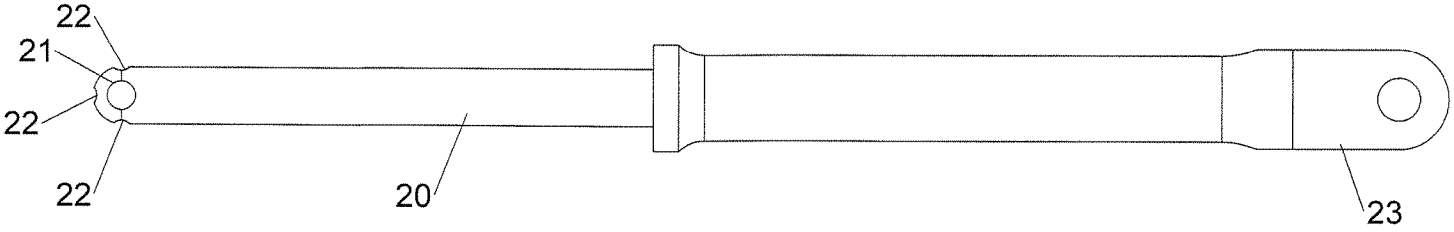
FIG. 3 is a front view of the second body of the tool assembly of the present invention.
Figure 4:
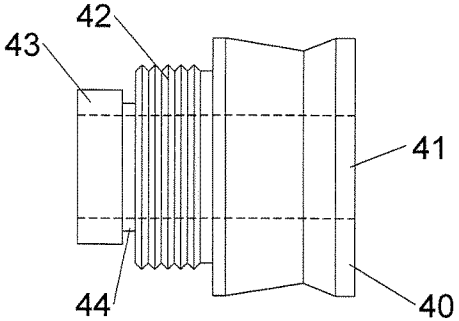
FIG. 4 is a front view of the connector of the tool assembly of the present invention.
Figure 5:
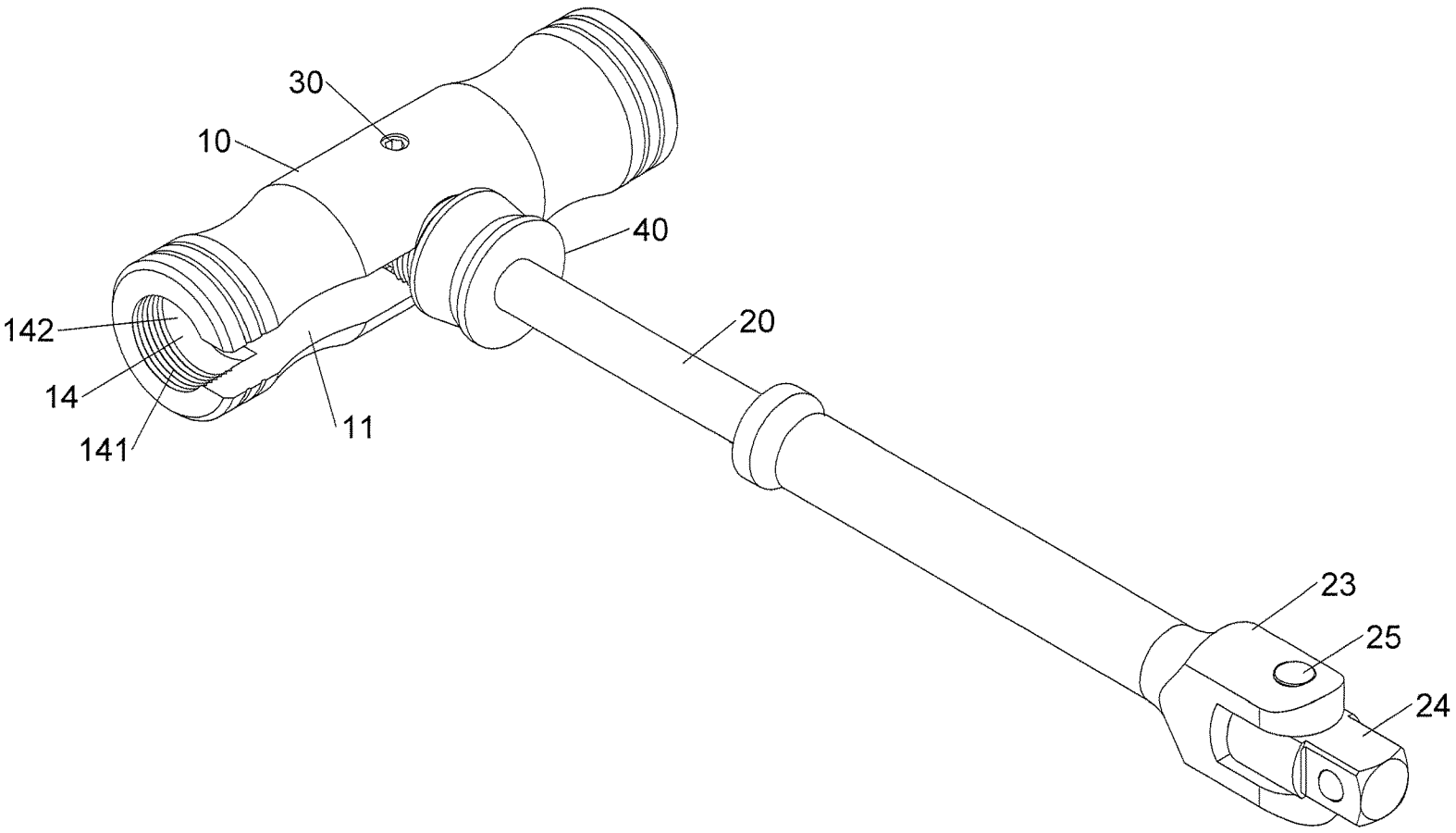
FIG. 5 is a perspective view to show the tool assembly of the present invention.

Referring to FIGS. 1 to 5, the tool assembly of the present invention comprises a first body 10 having a first end and a second end, and a slot 11 is defined through the wall of the body 10 and extends from the second end of the first body 10 to the middle portion of the first body 10. A radial hole 12 is defined through the wall of the first body 10 and communicates with the slot 11. The slot 11 has a first end and a second end, wherein the first end of the slot 11 is located at the middle portion of the first body 10, and the second end of the slot 11 communicates with the second end of the first body 10. The first end of the slot 11 has a first connection portion 13 which includes first inner threads 131, and the second end of the slot 11 has a second connection portion 14 which includes second inner threads 141. The first connection portion 13 further includes a first non-threaded portion 132 located at the inner end thereof, and the second connection portion 14 further has a second non-threaded portion 142 located at the inner end thereof. The slot 11 includes two recesses 15 defined in the inner end of the first end thereof. The first body 10 includes a room 16 defined in the first end thereof.

A second body 20 is an elongate rod, and has a first end and a second end. The first end of the second body 20 is an insertion end 21 which is inserted into and connected to the first end of the slot 11 by a pivot 30, such that the second body 20 is pivotable about the pivot 30 relative to the first body 10. The second body 20 includes a pivotal portion 23 on the second end thereof. The pivotal portion 23 is a U-shaped portion and includes two lugs between which an opening 231 is defined. Each lug has an aperture 232 defined therethrough. A bead receiving recess 233 is defined in the inner end of the opening 231. A ball 26 and a second spring 27 are received in the bead receiving recess 233. A part 24 is pivotably connected between the two lugs and located in the opening 231. The part 24 has a connection end 241 on the first end thereof and a passage 242 defined through the second end of the part 24. The connection end 241 is a square head and the passage 242 faces the apertures 232. A pin 25 extends through the apertures 232 and the passage 242 so that the part 24 is pivotable an angle up to 180 degrees about the pin 25 relative to the second body 20. The ball 26 is biased by the second sprig 27 to contact one of the first and second ends of the part 24.

A connector 40 has an axial hole 41 defined axially therethrough, and has outer threaded section 42 formed on the first end thereof. When the second body 20 is positioned at an angle, 90 degrees for example, relative to the first body 10, the outer threaded section 42 is connected to the first inner threads 131 of the first connection portion 13. When the second body 20 is positioned along the axial axis of the first body 10, the outer threaded section 42 is connected to the second inner threads 141 of the second connection portion 14.

The connector 40 has an end section 43 extending axially from the first end thereof. The outer diameter of the end section 43 is smaller than the inner diameter of the first inner threads 131 of the first connection portion 13. A groove 44 is defined in the outside of the connector 40 and located between the outer threaded section 42 and the end section 43. A washer 50 is made of resilient material and mounted to the end section 43. The outer diameter of the washer 50 is equal to or larger than the inner diameter of first inner threads 131 of the first connection portion 13 and an inner diameter of a second connection portion 14. When the connector 40 is partially connected to the first connection portion 13 or the second connection portion 14, the washer 50 is force-fitted with the first inner threads 131 of the first connection portion 13 or the second inner threads 141 of the second connection portion 14.

An engaging unit 60 includes a bead 61 and a first spring 62. The second body 20 includes three notches 22 defined in the first end thereof. Each recess 15 receives a bead 61 and a first spring 62. The bead 61 is pushed by the first spring 62 to be engaged with the notch 22 corresponding thereto. Therefore, when the second body 20 is pivoted relative to the first body 10 to the first connection portion 13 or the second connection portion 14, the second body 20 is well positioned.

Figure 6:
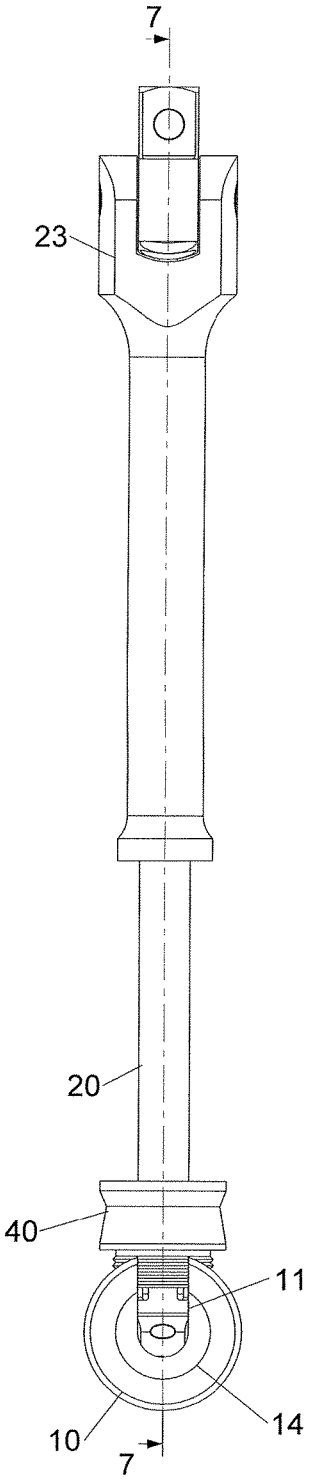
FIG. 6 is a front view of the tool assembly of the present invention.
Figure 7:
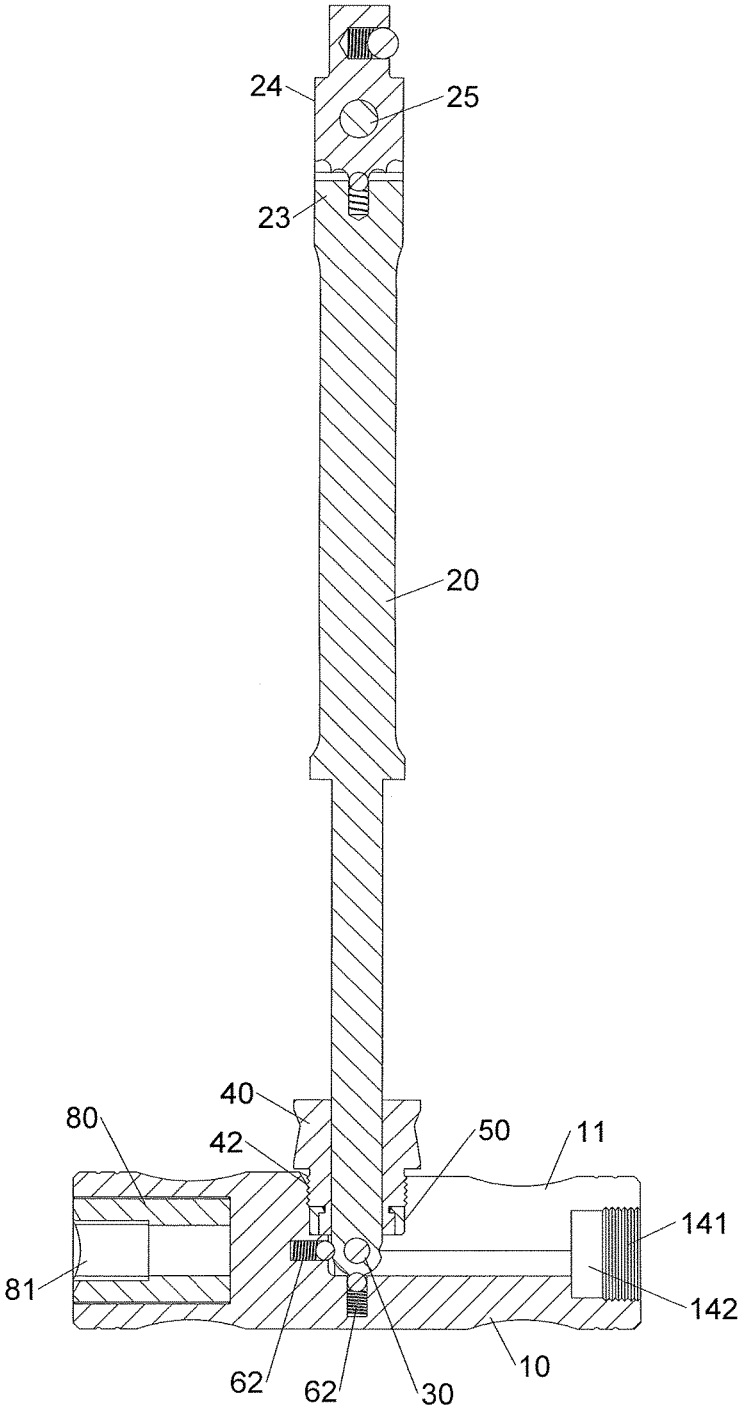
FIG. 7 is a cross sectional view, taken along line 7-7 in FIG. 6.

As shown in FIGS. 6 and 7, the ball 26 and the second spring 27 are received in the bead receiving recess 233. The ball 26 is biased by the second sprig 27 to contact one of the first and second ends of the part 24. The washer 50 is mounted to the end section 43, and the outer threaded section 42 is connected to the first inner threads 131. The washer 50 is mounted to the first non-threaded portion 132 so that the second body 20 is restricted the connector 40 and the first connection portion 13, so that the first and second bodies 10, 20 form a T-shaped tool. The first spring 62 of the engaging unit 60 biases against the inside of the recess 15 and the bead 61, and the bead 61 is pushed by the first spring 62 to be engaged with the notch 22 of the second body 20. A part 80 is inserted into the room 16 defined in the first end of the body 10.

Figure 8:
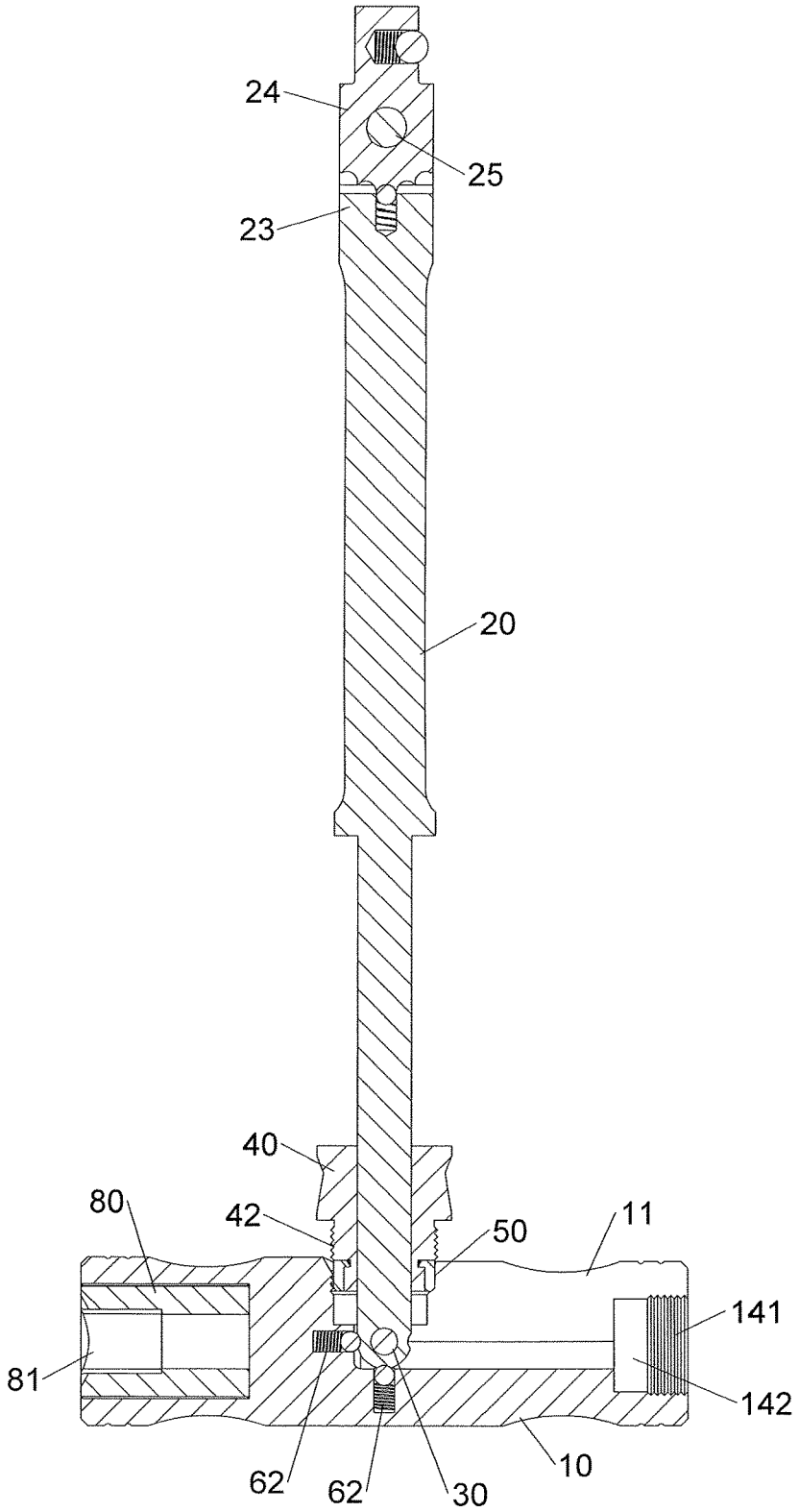
FIG. 8 is a cross sectional view, taken along line 7-7 in FIG. 6 to show the operational status.

As shown in FIG. 8, the washer 50 is force-fitted with the first inner threads 131, and the outer threaded section 42 is exposed beyond the first connection portion 13. The first and second body 10, 20 now are in the first status of connection.

Figure 9:
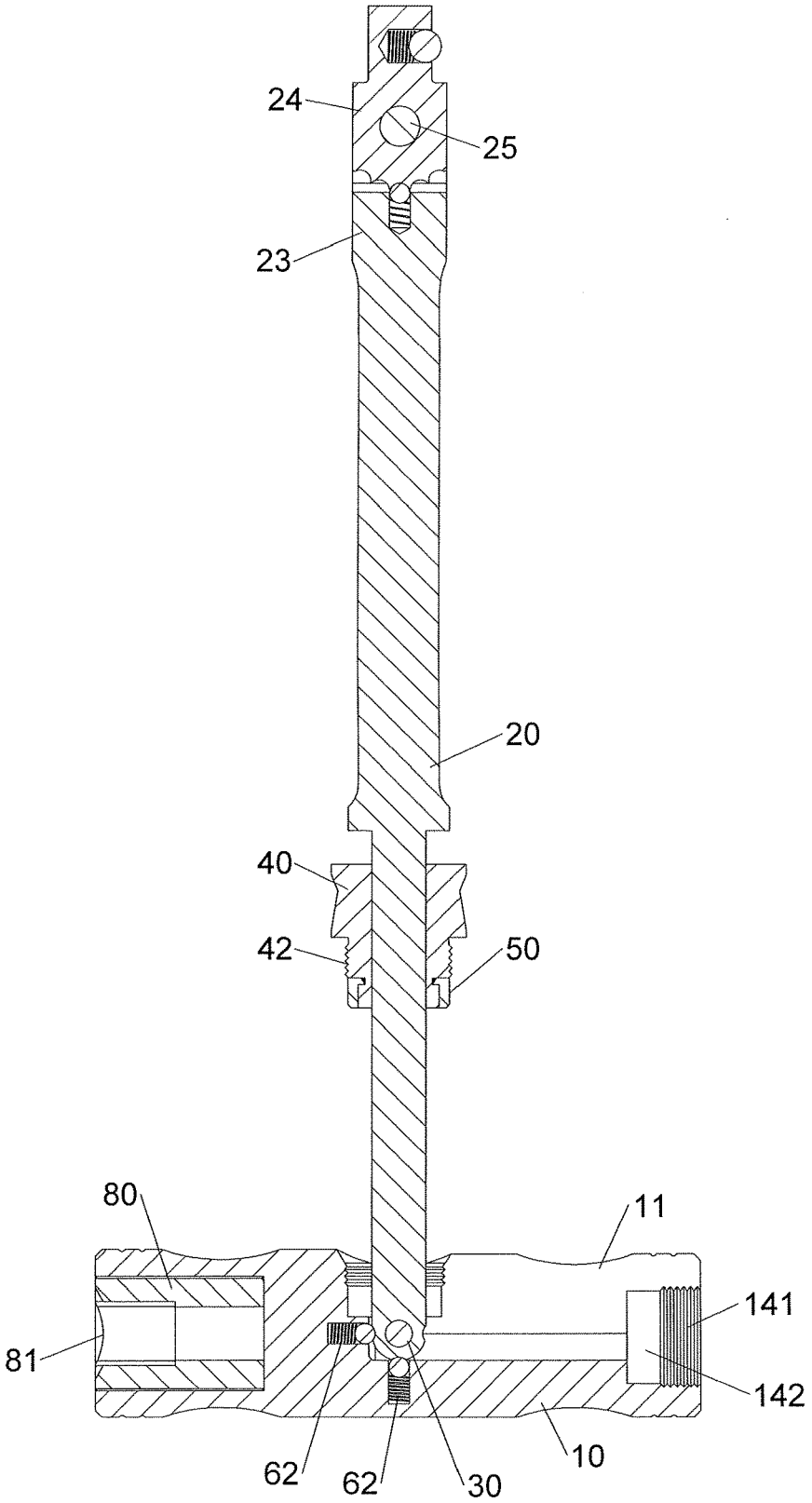
FIG. 9 shows that the connector is separated from the first body.

As shown in FIG. 9, when the connector 40 and the washer 50 are separated from the first connection portion 13, the second body 20 is pivoted about the pivot 30 relative to the first body 10.

Figure 10:
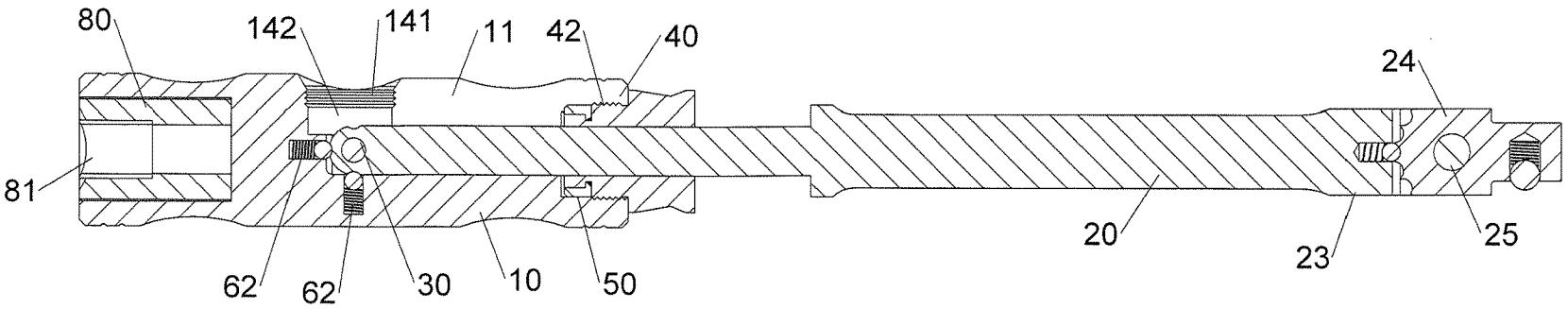
FIG. 10 shows the second operational status of the tool assembly of the present invention.

As shown in FIG. 10, when the connector 40 and the washer 50 are separated from the first connection portion 13, the second body 20 is pivoted an angle of 90 degrees about the pivot 30 relative to the first body 10 so that the first and second bodies 10, 20 share a common axis and form a straight tool.

The connector 40 is connected to the second connection portion 14, and the outer threaded section 42 is connected to the second inner threads 141. The washer 50 is mounted to the second non-threaded portion 142. The part 80 is connected to the first end of the first body 10 and the reception hole 81 is exposed. The connection end 241 is located at the first end of the first body 10.

Figure 11:
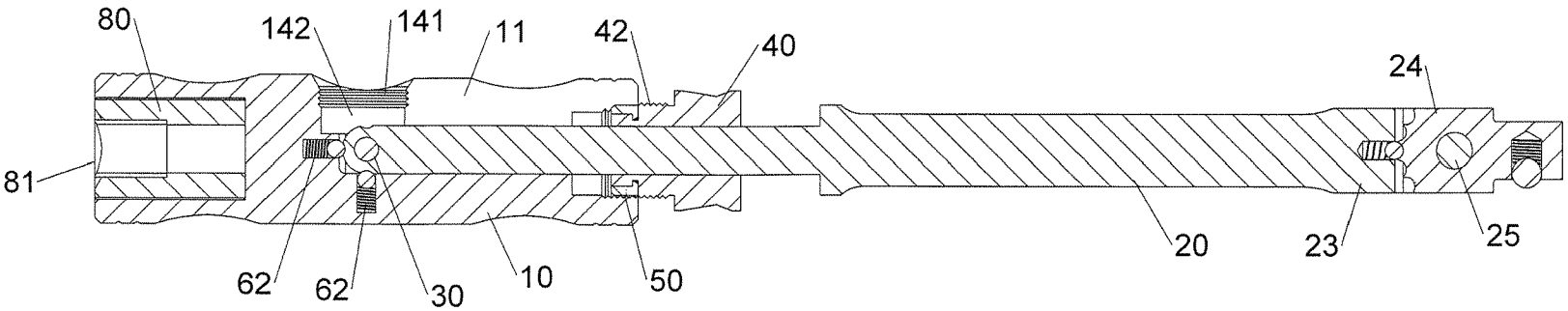
FIG. 11 shows the second action of the second operational status of the tool assembly of the present invention.

As shown in FIG. 11, the washer 50 is engaged with and force-fitted to the second inner threads 141. The outer threaded section 42 is exposed beyond the second connection portion 14. The first and second body 10, 20 now are in the second status of connection.

Figure 12:
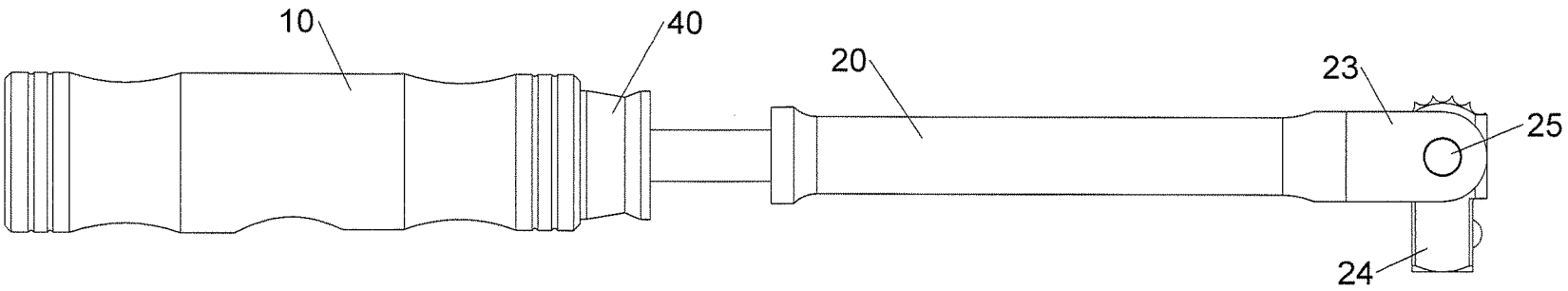
FIG. 12 shows the third action of the second operational status of the tool assembly of the present invention.

As shown in FIG. 12, when the first and second bodies 10, 20 form a straight tool, the part 24 is able to pivot about the pin 25 for an angle of 90 degrees to arrange the first and second bodies 10, 20 to be an L-shaped tool. The first body 10 performs as a handle, and the connection end 241 is connected with other tools.

Figure 13:
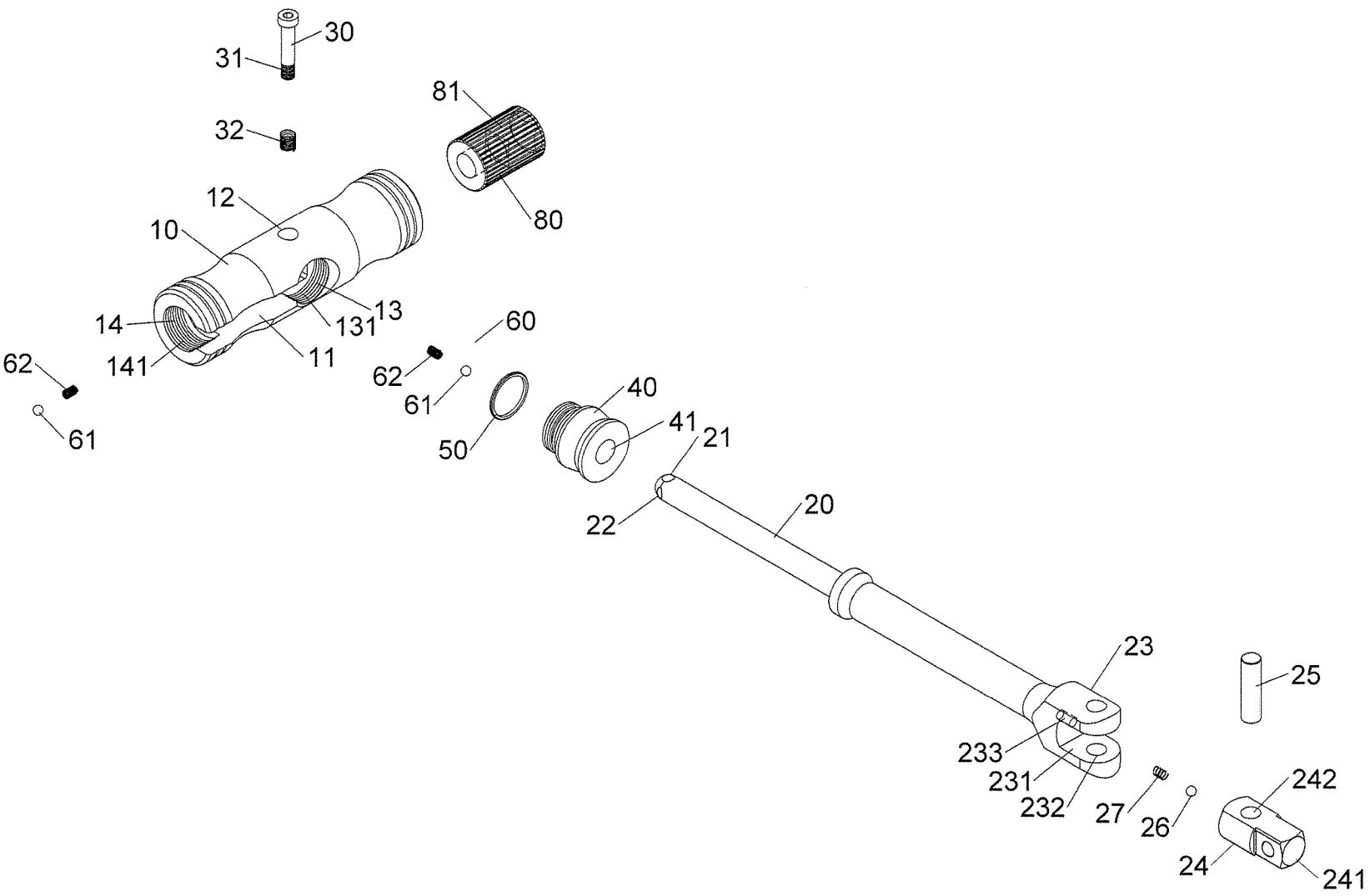
FIG. 13 is an exploded view of the second embodiment of the tool assembly of the present invention.
Figure 14:
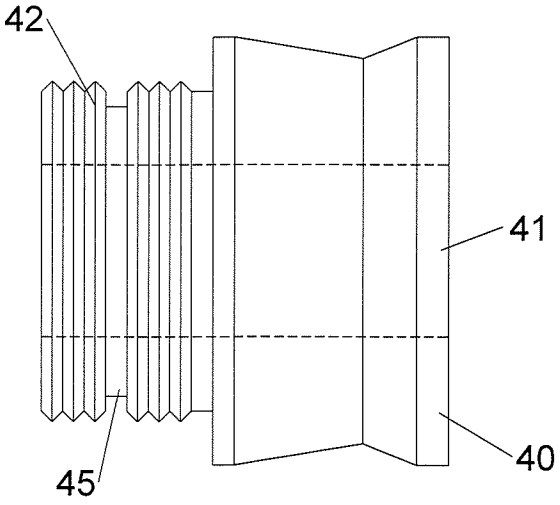
FIG. 14 is a side view of the connector of the second embodiment of the tool assembly of the present invention.
Figure 15:
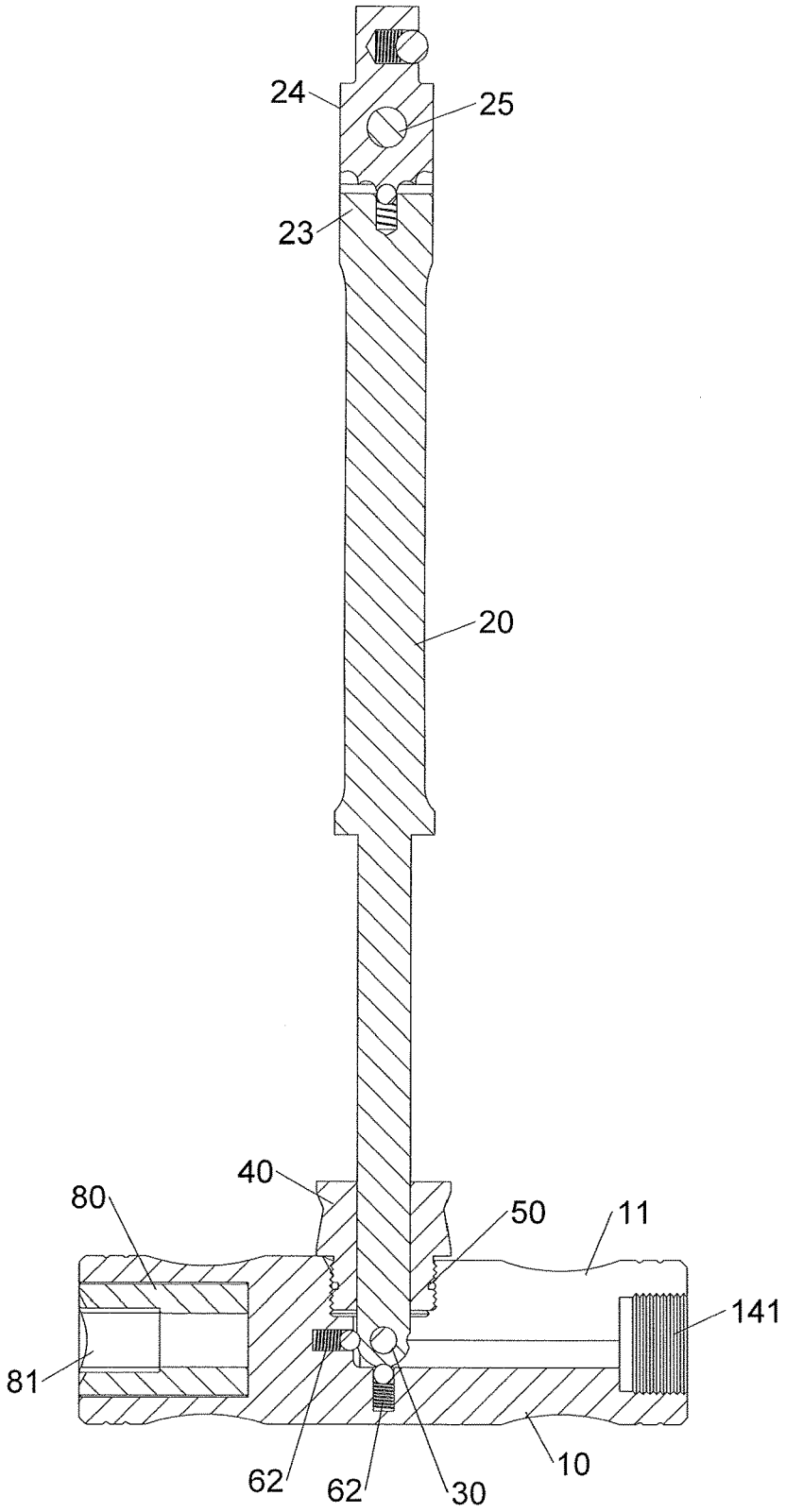
FIG. 15 is a cross sectional view of the second embodiment of the tool assembly of the present invention.

As shown in FIGS. 13 to 15, first and second connection portions 13, 14 each do not have the first/second non-threaded portion 132/142. A third spring 32 is mounted to the pivot 30 and biased between the second body 20 and the pivot 30. The second body 20 pivots about the pivot 30 with resistance. The connector 40 does not have the end section 43. An annular groove 45 is defined in the outer threaded section 42. The washer 50 is a ring-shaped member and is engaged with the annular groove 45. The washer 50 contacts the first and second inner threads 131, 141 so that the connector 40 is not easily separated from the first and second connection portions 13, 14. The washer 50 provides an axial force to the outer threaded section 42.

Figure 16:
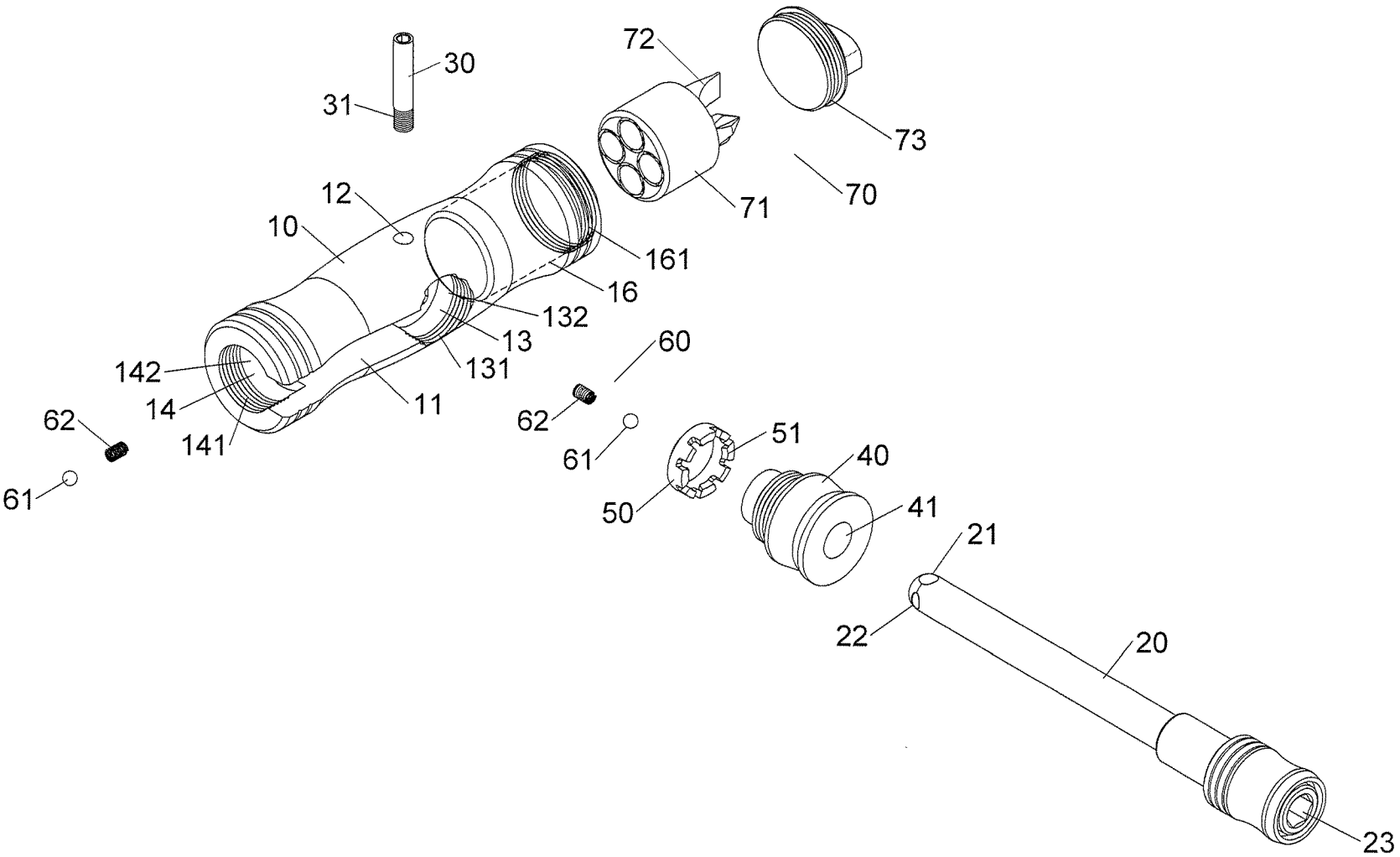
FIG. 16 is an exploded view of the third embodiment of the tool assembly of the present invention.

As shown in FIG. 16, the room 16 includes third threaded portion 161 defined therein. The second end of the second body 20 is a hexagonal recess. The pivotal portion 23 does not have the part 24, the pin 25, the ball 26 and the second spring 27. A tool unit 70 is received in the room 16 and includes a seat 71, multiple tools 72 and a cover 73. The seat 71 includes multiple hexagonal recesses which receive the multiple tools 72. The first tools 72 are bits of different sizes and able to be pivotably connected to the pivotal portion 23. The cover 73 is connected to the third threaded portion 161 of the room 16 to seal the room 16.

Figure 17:
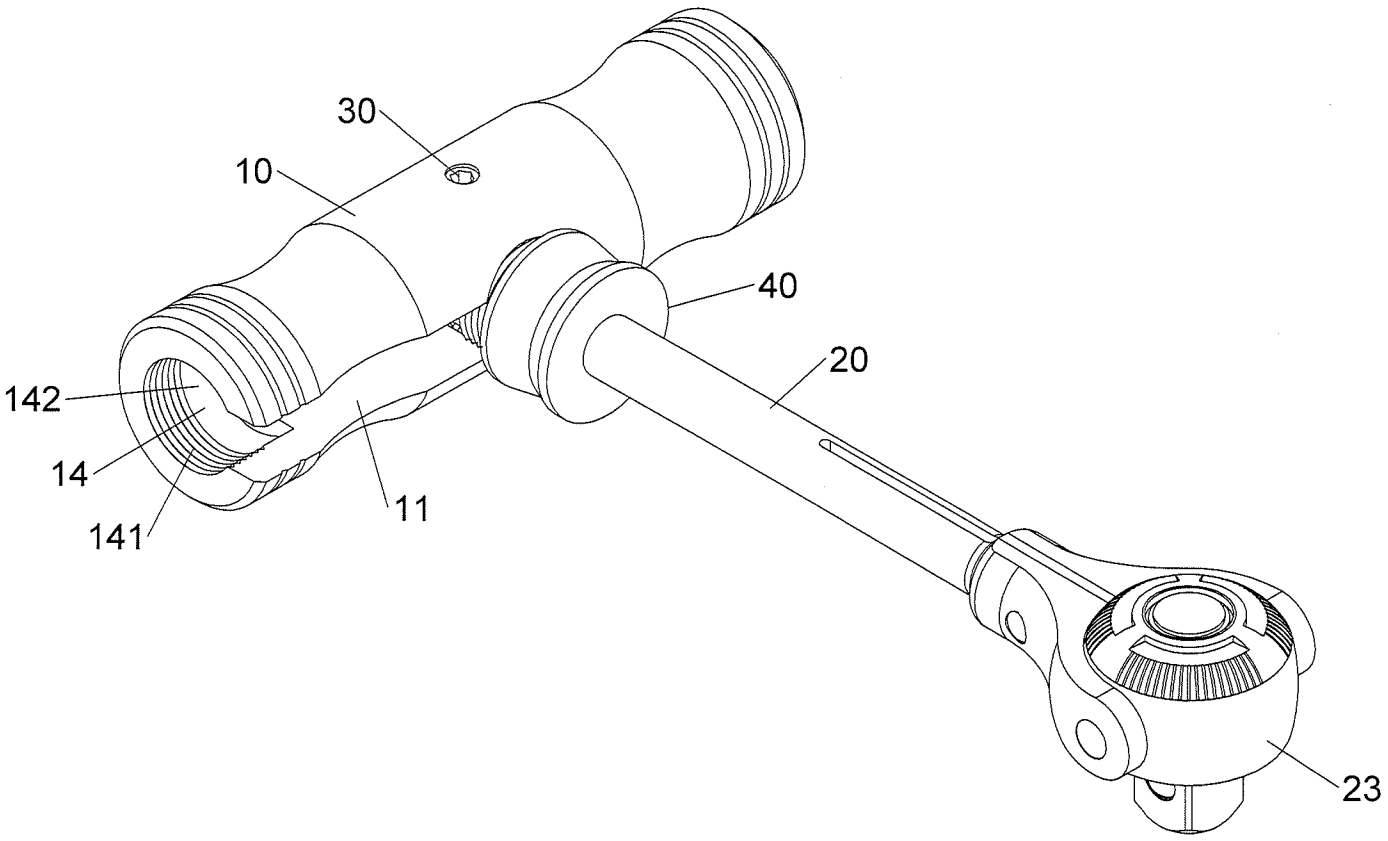
FIG. 17 is a perspective view of the fourth embodiment of the tool assembly of the present invention.
Figure 18:
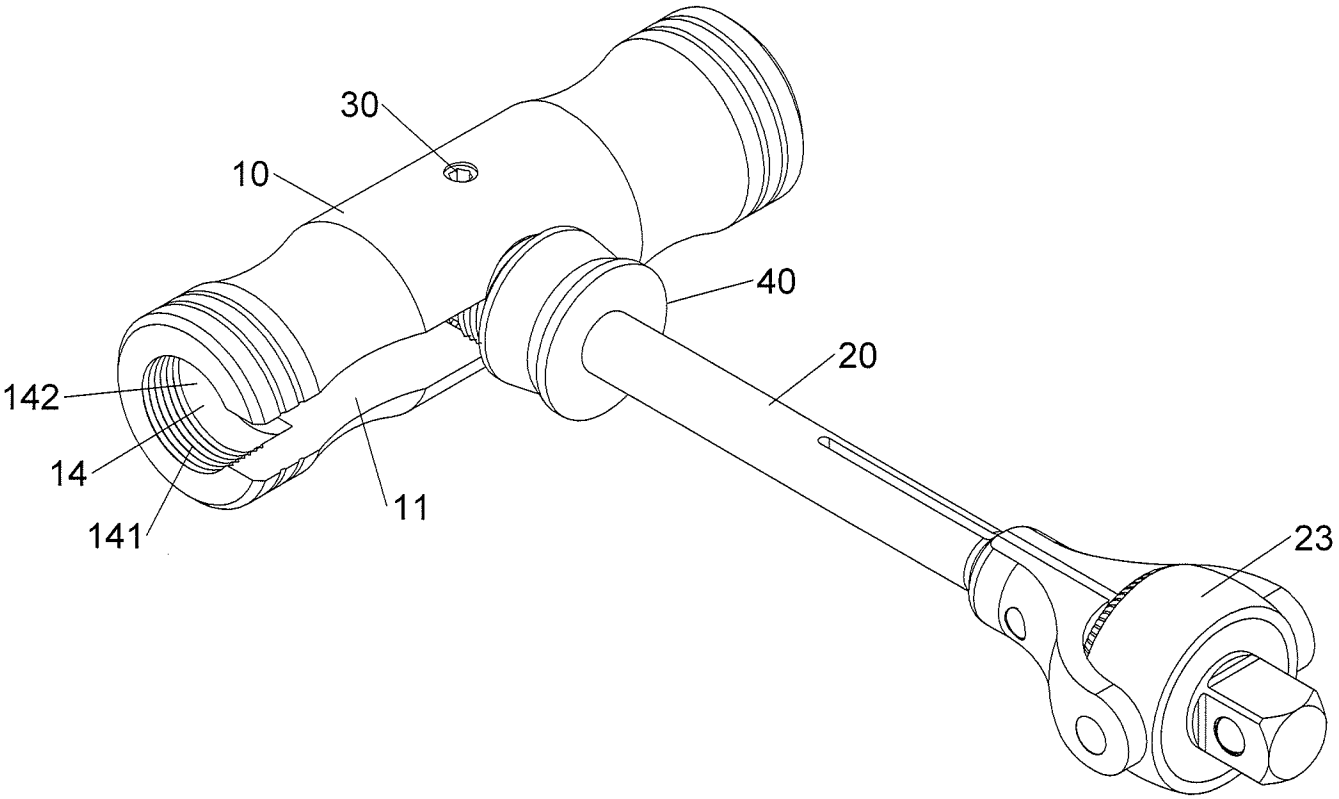
FIG. 18 is a perspective view of the fifth embodiment of the tool assembly of the present invention.
Figure 19:
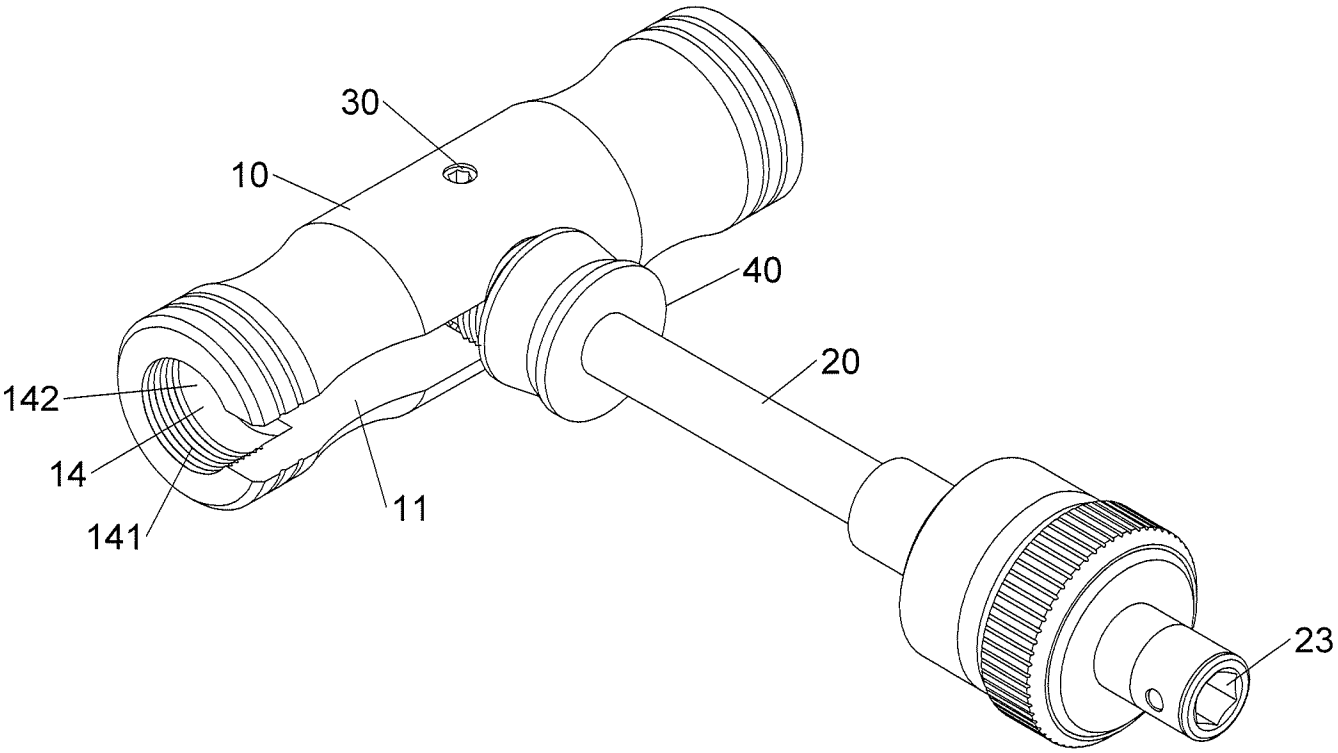
FIG. 19 is a perspective view of the sixth embodiment of the tool assembly of the present invention.

As shown in FIGS. 17 and 18, the pivotal portion 23 is able to rotate 360 degrees relative to the second body 20, and does not have the part 24, the pin 25, the ball 26 and the second spring 27.

The advantages of the present invention are that the connector 40 is connected to the second body 20 which is inserted into the axial hole 41. The outer threaded section 42 is connected to the first inner threads 131 or the second inner threads 141 to securely connect the first body 10 to the second body 20. The connector 40 does not separate from the first body 10 by any impact.

The outer threaded section 42 is connected to the first inner threads 131 or the second inner threads 141, and the washer 50 on the end section 43 is mounted to the first or second non-threaded portion 132, 142. The first and second bodies 10, 20 form a T-shaped tool or a straight tool.

The washer 50 is mounted to the end section 43, the washer 50 is force-fitted to the first or second inner threads 131, 141. The outer threaded section 42 is exposed beyond the first or second connection portions 13, 14. The first and the second bodies 10, 20 are in a normal connection relationship.

The tool assembly of the present invention can choose secure connection relationship or normal connection relationship. When the tool assembly is brought to a higher position, the first body 10, the second body 20 and the connector 40 should be connected to each other I the secure connection relationship to avoid unexpectedly separation.

The pin 25 extends through the apertures 232 and the passage 242, so that the part 24 is pivoted an angle of 180 degrees about the pin 25, and the second body 20 and the connector 40 can be set as a straight status or an L-shaped status.

When the first and second bodies 10, 20 form a straight tool, the reception hole 81 and the connection end 241 can be respectively connected to different parts or tools.

As shown in FIG. 12, when the first and second bodies 10, 20 form a straight tool, the part 24 is able to pivot about the pin 25 for an angle of 90 degrees to arrange the first and second bodies 10, 20 to be an L-shaped tool. The connection end 241 is connected with a tool or part having a rectangular recess.

The bead 61 and the first spring 62 are received in the recess 15, and the bead 61 is biased by the first spring 62 to contact the notch 22 so that when the second body 20 is rotated relative to the first body 10 to the first or second connection portions 13, 14, the second body 20 is well positioned.

While we have shown and described the embodiment in accordance with the present invention, it should be clear to those skilled in the art that further embodiments may be made without departing from the scope of the present invention.

What is claimed is:

1. A tool assembly comprising:

a first body having a first end and a second end, a slot defined through a wall of the body and extending from the second end of the first body to a middle portion of the first body, the slot having a first end and a second end, the first end of the slot located at the middle portion of the first body, the second end of the slot communicating with the second end of the first body, the first end of the slot having a first connection portion which includes first inner threads, the second end of the slot having a second connection portion which includes second inner threads;

a second body which is an elongate rod, and having a first end and a second end, the first end of the second body pivotably connected to the first end of the slot by a pivot, the second body being pivotable about the pivot relative to the first body, and a connector having an axial hole defined axially therethrough, the connector having outer threaded section formed on a first end thereof, when the second body is positioned at an angle relative to the first body, the outer threaded section connected to the first inner threads of the first connection portion, when the second body is positioned along an axial axis of the first body, the outer threaded section connected to the second inner threads of the second connection portion, wherein, the connector has an end section extending axially from the first end thereof, an outer diameter of the end section is smaller than an inner diameter of the first inner threads of the first connection portion, a groove defined in an outside of the connector and located between the outer threaded section and the end section, a washer is made of resilient material and mounted to the end section, an outer diameter of the washer is equal to or larger than the inner diameter of first inner threads of the first connection portion and an inner diameter of a second connection portion, when the connector is partially connected to the first connection portion or the second connection portion, the washer is force-fitted with the first inner threads of the first connection portion or the second inner threads of the second connection portion.

2. The tool assembly as claimed in claim 1, wherein the first connection portion includes a first non-threaded portion located at an inner end thereof, the second connection portion has a second non-threaded portion located at an inner end thereof, when the connector is connected to the first connection portion or the second connection portion, the outer threaded section is threadedly connected to the first inner threads or the second inner threads, the washer is force-fitted to the first non-threaded portion or the second non-threaded portion.

3. The tool assembly as claimed in claim 1, wherein the washer includes multiple protrusions extending from an outer periphery thereof, the protrusions are engaged with the groove.

4. The tool assembly as claimed in claim 1, wherein the slot includes two recesses defined in an inner end of the first end thereof, the second body includes three notches defined in the first end thereof, each recess receives a bead and a spring, the bead is pushed by the spring to be engaged with the notch corresponding thereto.

5. The tool assembly as claimed in claim 1, wherein the second body includes a pivotal portion on the second end thereof, the pivotal portion is a U-shaped portion and includes two lugs between which an opening is defined, each lug has an aperture defined therethrough, a bead receiving recess is defined in an inner end of the opening, a part is pivotably connected between the two lugs and located in the opening, the part has a connection end on a first end thereof and a passage defined through a second end of the part, the connection end is a square head and the passage faces the apertures, a pin extends through the apertures and the passage so that the part is pivotable an angle up to 180 degrees about the pin relative to the second body, a ball and a spring are received in the bead receiving recess, the ball is biased by the sprig to contact one of the first and second ends of the part.

6. The tool assembly as claimed in claim 1, wherein a spring is mounted to the pivot and biased between the second body and the pivot, the second body pivots about the pivot with resistance.

7. The tool assembly as claimed in claim 6, wherein the first body includes a room defined in the first end thereof, a second tool has a first end thereof force-fitted to the room, the second tool includes a reception hole defined in a second end thereof, the reception hole is a rectangular hole.

8. The tool assembly as claimed in claim 1, wherein the first body includes a room defined in the first end thereof, the room includes third threaded portion defined therein, the second end of the second body is a hexagonal recess.

9. The tool assembly as claimed in claim 8, wherein a tool unit is received in the room and includes a seat, multiple first tools and a cover, the seat includes multiple hexagonal recesses which receive the multiple first tools, the first tools are bits of different sizes and able to be pivotably connected to the pivotal portion the cover is connected to the third threaded portion of the room to seal the room.

* * * * *